US006428366B1

(12) United States Patent
Purushothaman et al.

(10) Patent No.: US 6,428,366 B1
(45) Date of Patent: Aug. 6, 2002

(54) ELECTRICAL TERMINAL SOCKET AND METHOD OF FABRICATING SAME

(75) Inventors: Vinodh Purushothaman, Rochester Hills; Adam Tyler, Lake Orion, both of MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/706,290

(22) Filed: Nov. 3, 2000

(51) Int. Cl.[7] ..... H01R 11/22

(52) U.S. Cl. ..... 439/851; 439/852; 439/843; 439/861

(58) Field of Search ..... 439/851, 852, 439/861, 839, 842, 843

(56) References Cited

U.S. PATENT DOCUMENTS

| | | | | |
|---|---|---|---|---|
| 4,838,816 A | | 6/1989 | Matsusaka et al. | 439/861 |
| 5,112,254 A | | 5/1992 | Endo | 439/852 |
| 5,443,592 A | | 8/1995 | Ittah et al. | 439/851 |
| 5,624,289 A | * | 4/1997 | Kourimsky et al. | 439/852 |
| 5,791,945 A | | 8/1998 | Myer et al. | 439/852 |
| 5,860,836 A | * | 1/1999 | Ohno | 439/852 |
| 5,947,777 A | * | 9/1999 | Chaillot et al. | 439/852 |

* cited by examiner

*Primary Examiner*—Tho D. Ta
(74) *Attorney, Agent, or Firm*—Stacey E. Caldwell

(57) ABSTRACT

An electrical terminal socket is provided for receiving a terminal pin member. The socket is stamped and formed from a single sheet of conductive metal material and includes a base wall, and a pair of side walls folded upwardly from opposite sides of the base wall. A top wall is folded inwardly from the top of one of the side walls, whereby the base wall, side walls and top wall define a socket with an opening at a front end thereof for receiving the terminal pin member. A terminating section extends from the base wall at a rear end of the socket. A spring arm is folded downwardly from a rear end of the top wall into the socket. The spring arm is tapered from a wide end thereof joined to the top wall to a narrow free end thereof which does not interfere with the terminating section during stamping and forming of the electrical terminal socket.

18 Claims, 4 Drawing Sheets

ELECTRICAL TERMINAL SOCKET AND METHOD OF FABRICATING SAME

FIELD OF THE INVENTION

This invention generally relates to the art of electrical connectors and, particularly, to an electrical terminal socket for receiving a terminal pin member, along with a method of fabricating the socket.

BACKGROUND OF THE INVENTION

Generally, electrical connector assemblies typically include a pair of mating connectors, such as a female or receptacle connector and a male or plug connector. The respective connectors mount a plurality of conductive terminals which interengage to establish one or more electrical circuits through the mating connectors. The terminals, for instance, may include a terminal socket in one of the mating connectors for receiving a terminal pin on the other mating connector.

Electrical connectors of the character described above conventionally include dielectric housings which are relatively inexpensively molded of plastic material or the like. The terminals, on the other hand, typically are fabricated of conductive metal material and comprise the bulk of the expense in manufacturing such connectors. For instance, pin and socket terminals may be stamped and formed from conductive sheet metal material which, in addition, may or may not be plated with highly conductive precious metal. The terminals are fabricated by stamping a "blank" out of the sheet metal material, the flat blank including all of the elements of the terminal. The stamped blank then is formed, as by folding, into the ultimate shape or configuration of the terminal. A terminal socket may include quite a number of elements, such as a plurality of walls which form the socket, along with contact spring fingers which engage the mating terminal pin, as well as terminating sections such as crimp arms or the like. All of these elements must be included in the flat blank which is stamped from a single sheet of conductive metal material. Problems continuously are encountered in designing an electrical terminal socket which includes all of the necessary mechanical and electrical elements thereof, but which is capable of being efficiently stamped from the sheet metal material without wasting considerable material about the stamped blank from which the terminal socket is formed. The present invention is directed to solving this problem by providing an electrical terminal socket which may be stamped and formed from a single sheet of conductive metal material in an efficient or metal saving design.

SUMMARY OF THE INVENTION

An object, therefore, of the invention is to provide a new and improved electrical terminal socket of the character described, for receiving a terminal pin member. The terminal socket is stamped and formed from a single sheet of conductive metal material.

Another object is to provide a new and improved method of fabricating the terminal socket.

In the exemplary embodiment of the invention, the terminal socket includes a base wall and a pair of side walls folded upwardly from opposite sides of the base wall. A top wall is folded inwardly from the top of one of the side walls, whereby the base wall, side walls and top wall define a socket with an opening at a front end thereof for receiving the terminal pin member. A terminating section extends from the base wall at a rear end of the socket. A spring arm is folded downwardly from a rear end of the top wall into the socket. The spring arm is tapered from a wide end thereof joined to the top wall to a narrow free end thereof which does not interfere with the terminating section during stamping and forming of the electrical terminal socket.

As disclosed herein, the spring arm comprises a first spring arm, and a second spring arm is folded downwardly from a front end of the top wall into the socket. The second spring arm includes a free end engageable with the terminal pin member inserted into the socket. The narrow free end of the first spring arm is located behind the free end of the second spring arm to provide spring backup therefore.

According to another aspect of the invention, the top wall comprises a first top wall, and including a second top wall folded inwardly from the top of the other of the side walls. The second top wall is folded over the top of the first top wall to provide rigid backing support therefore.

The terminating section of the terminal socket comprises a crimping section for clamping onto an appropriate electrical conductor. The crimping section includes at least one crimp arm extending laterally outwardly relative to the socket at a side thereof coincident with the one side from which the top wall is folded.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
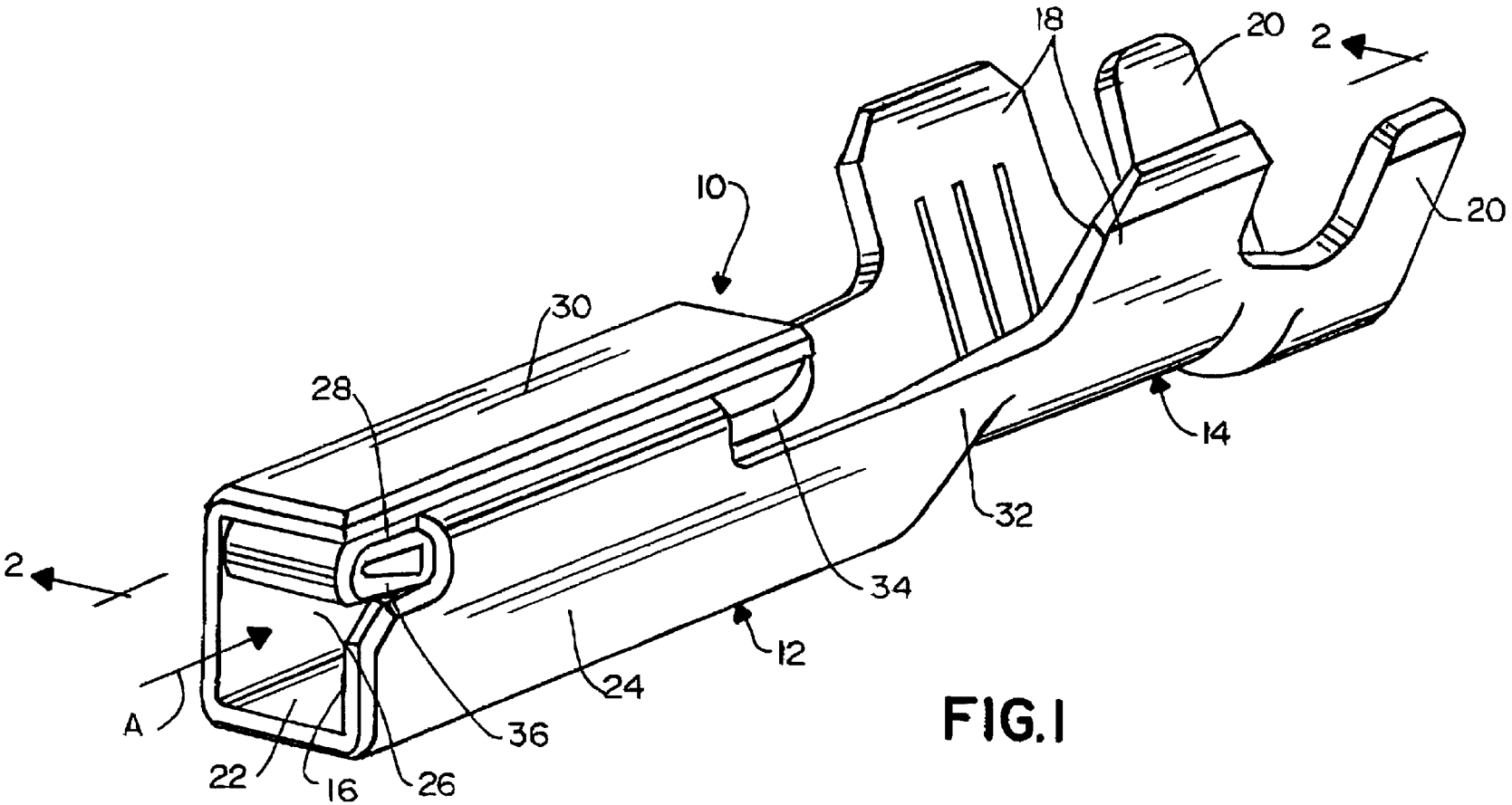
FIG. 1 is a front perspective view of an electrical terminal socket incorporating the concepts of the invention.
Figure 2:
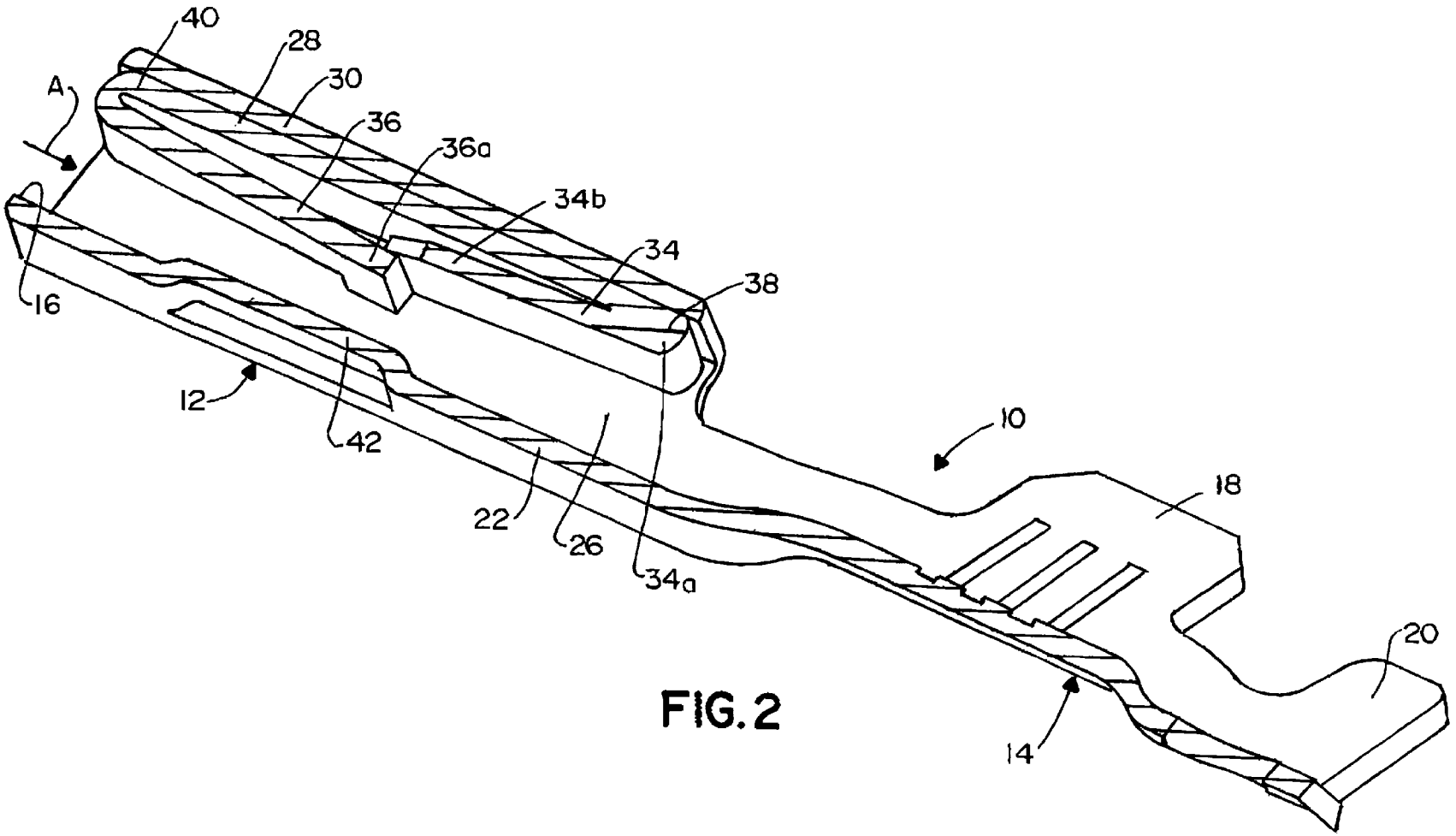
FIG. 2 is a vertical section taken generally along line 2—2 of FIG. 1.
Figure 3:
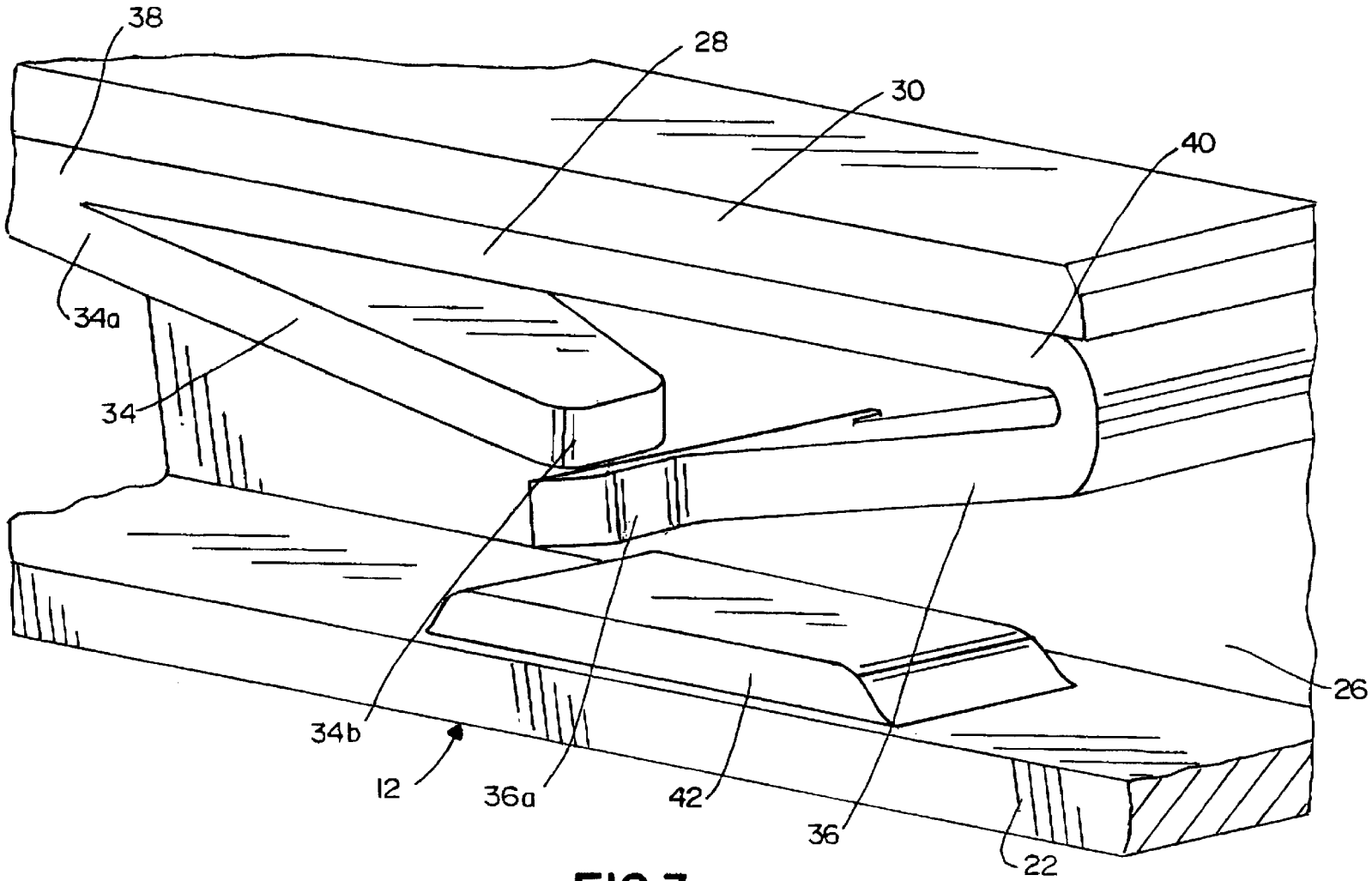
FIG. 3 is an enlarged vertical section taken solely through the socket portion of the terminal.

Referring to the drawings in greater detail, and first to FIGS. 1–3, the invention is embodied in an electrical terminal socket, generally designated 10, for receiving a terminal pin member inserted into the socket in the direction of arrow "A" (FIG. 1). Terminal socket 10 includes a front socket section, generally designated 12, and a rear terminating section, generally designated 14. The front socket section defines a front opening 16 for receiving the terminal pin member. The rear terminating section includes two pairs of crimp arms 18 and 20. Crimp arms 18 are provided for clamping onto the conductor of an electrical wire, while crimp arms 20 are provided for clamping onto the outer insulation of the wire.

Front socket section 12 of terminal socket 10 is generally rectangular in cross-section and includes a base wall 22 and a pair of side walls 24 and 26 folded upwardly from opposite sides of the base wall. A first top wall 28 is folded inwardly from the top of side wall 24, and a second top wall 30 is folded inwardly from the top of side wall 26 over the top of first top wall 28. In other words, second top wall 30 is juxtaposed immediately on top of first top wall 28 to provide rigid support therefore, as all of bottom wall 22, side walls 24 and 26 and top walls 28 and 30 combine to form a rectangular configuration for front socket section 12 of terminal socket 10. Side walls 24 and 26 extend rearwardly through a rectangular-to-round transition section 32 between front socket section 12 and rear terminating section 14.

As best seen in FIGS. 2 and 3, first and second spring arms 34 and 36 are folded downwardly from opposite ends of first top wall 28 and into the interior of front socket section 12. Specifically, first spring arm 34 is folded downwardly from a rear end 38 of top wall 28 into the socket. The spring arm is tapered from a wide end 34*a* thereof joined to the top wall to a narrow free end 34*b* thereof. Second spring arm 36 is folded downwardly from a front end 40 of first top wall 28 into the socket. The second spring arm terminates in a free end 36*a* which is engageable with the terminal pin member inserted into the socket in the direction of arrow "A". It can be seen in FIGS. 2 and 3 that narrow end 34*b* of first spring arm 34 is located immediately behind free end 36*a* of second spring arm 36 to provide spring backup therefore. Finally, an inwardly directed biasing ramp 42 is stamped out of bottom wall 22 immediately opposite free end 36*a* of spring arm 36.

When the terminal pin member is inserted into front socket section 12 of terminal socket 10 through opening 16 in the direction of arrow "A", a very robust contacting structure is provided by the above-described design. Specifically, the terminal pin member will engage between free end 36*a* of spring arm 36 and biasing ramp 42 which acts as a rigid anvil at the bottom of the socket. Free end 36*a* of spring arm 36, in turn, is backed up by free end 34*b* of spring arm 34. In addition, top walls 28 and 30 provide a double thickness which prevents any warping of the top wall as the terminal pin member is inserted into the socket.

Figure 4:
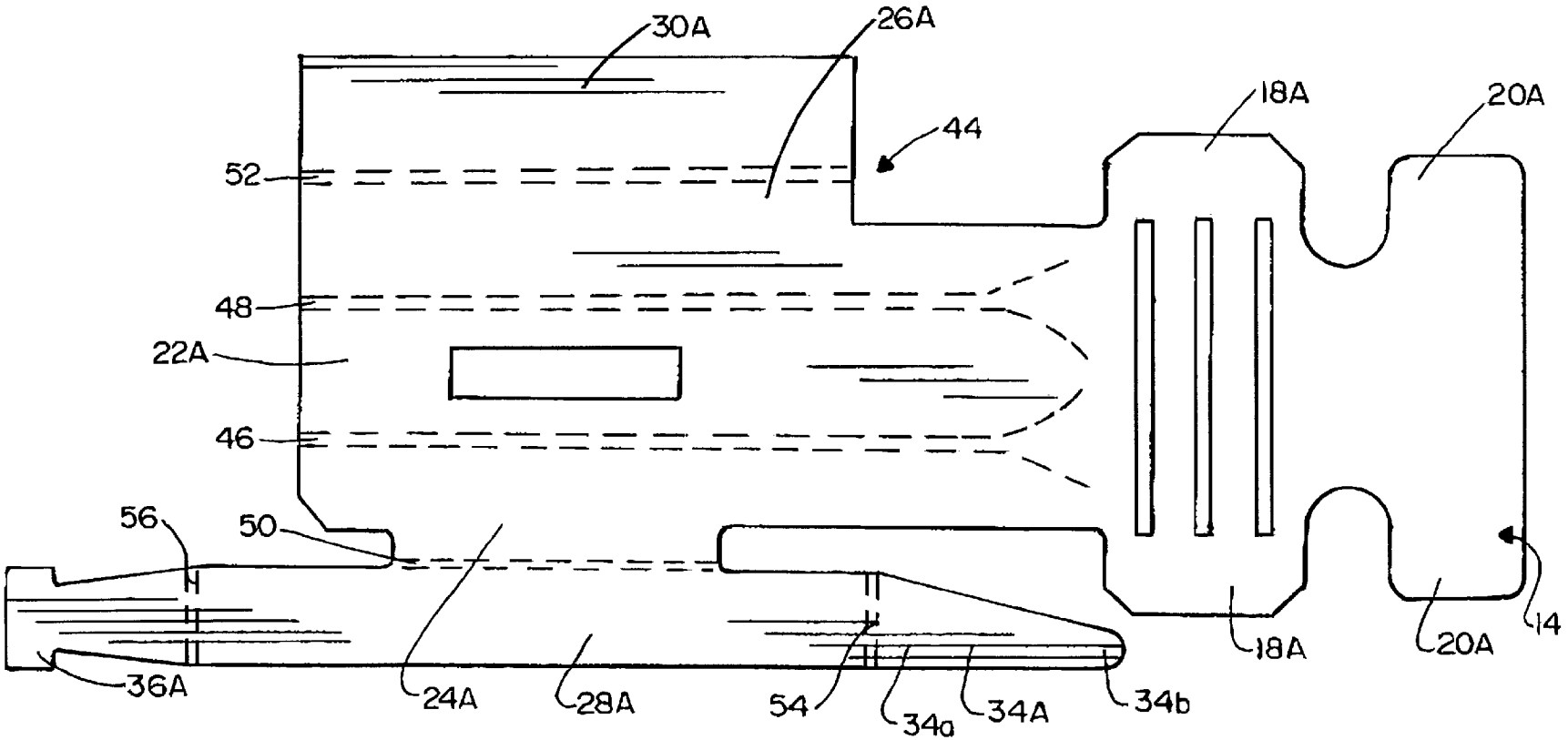
FIG. 4 is a plan view of a stamped sheet metal blank from which the terminal of FIG. 1 is formed.

FIG. 4 shows a blank, generally designated 44, which has been stamped from a single sheet of conductive metal material in order to form terminal socket 10 therefrom. The blank includes a central base wall section 22A between a pair of fold lines 46 and 48. A first side wall section 24*a* is located between fold line 46 and a third fold line 50. A second side wall section 26A is located between fold line 48 and a fourth fold line 52. A first top wall section 28A is located outside fold line 50, and a second top wall section 30A is located outside fold line 52. A first spring arm section 34A projects rearwardly from a fold line 54 at the rear of top wall section 28A, and a second spring arm section 36A extends forwardly from a fold line 56 at the front of first spring arm section 28A. Crimp arm sections 18A and 20A are stamped at the rear of blank 44 and are folded into the configuration of crimp arms 18 and 20, respectively, as shown in FIG. 1 and described above.

After blank 44 is stamped as described above in relation to FIG. 4, side wall sections 24A and 26A are folded upwardly on fold lines 46 and 48, respectively, to form side walls 24 and 26 of socket section 12 as shown in FIG. 1. Either before or after the upward folding of the side wall sections, spring arm sections 34A and 36A are folded on fold lines 54 and 56, respectively, inside top wall section 28A to form spring arms 34 and 36 as seen in FIGS. 2 and 3. Top wall section 28A, along with the inwardly folded spring arms, is folded inwardly about fold line 50 to form top wall 28 of the socket. Second top wall section 30A then is folded downwardly and inwardly about fold line 52 into juxtaposition on top of the previously folded first top wall 28, to form top wall 30 as seen in FIG. 1.

The significance of tapering spring arm section 34A which forms first spring arm 34 is clearly shown in FIG. 4. In other words, as stated above, the spring arm tapers from a wide end 34*a* thereof which is joined to top wall 28 (i.e., top wall section 28A of blank 44) to a narrow free end 34*b* thereof. It can be understood by the depiction of FIG. 4 that, if spring arm 34 (i.e., spring arm section 34A) is not tapered, not only would the beam characteristics be altered, but the spring arm would interfere with the adjacent crimp arm section 18A of the blank. That is to say, if spring arm section 34A is not tapered, either spring arm 34 would have to be shortened which would considerably alter the beam characteristics of the spring arm, or the entire blank 44 would have to be lengthened to move crimp arm sections 18A rearwardly of the blank, and this would result in a significant waste of sheet metal material, much less undesirably lengthening the entire terminal socket 10.

Such terms as "top", "bottom", "upwardly", "downwardly" and the like are not intended to be limiting in any way, since terminal socket 10 and its respective connector can function in any orientation. Such terms are used to provide a clear and concise understanding of the invention as the terminal socket is oriented in the drawings.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical terminal socket for receiving a terminal pin member, the terminal socket being stamped and formed from a single sheet of conductive metal material, comprising:

a base wall, a pair of side walls folded upwardly from opposite sides of the base wall, a top wall folded inwardly from the top of one of the side walls, whereby said base wall, side walls and top wall define a socket with an opening at a front end thereof for receiving the terminal pin member, a terminating section extending from the base wall at a rear end of the socket, and a spring arm folded downwardly from a rear end of the top wall into the socket, the spring arm being tapered from a wide end thereof substantially the same width as the top wall and joined to the top wall to a narrow free end thereof which does not interfere with the terminating section during stamping and forming of the electrical terminal socket.

2. The electrical terminal socket of claim 1 wherein said top wall comprises a first top wall, and including a second top wall folded inwardly from the top of the other of said side walls over the top of the first top wall.

3. The electrical terminal socket of claim 1 wherein said spring arm comprises a first spring arm, and including a second spring arm folded downwardly from a front end of the top wall into the socket.

4. The electrical terminal socket of claim 3 wherein said second spring arm includes a free end engageable with the terminal pin member inserted into said socket.

5. The electrical terminal socket of claim 4 wherein the narrow free end of said first spring arm is located behind the free end of the second spring arm to provide spring backup therefor.

6. The electrical terminal socket of claim 1 wherein said terminating section comprises a crimping section for clamping onto an appropriate electrical conductor.

7. The electrical terminal socket of claim 6 wherein said crimping section includes at least one crimp arm extending laterally outwardly relative to the socket at a side thereof coincident with said one side wall from which the top wall is folded.

8. An electrical terminal socket for receiving a terminal pin member, the terminal socket being stamped and formed from a single sheet of conductive metal material, comprising:

a base wall, a pair of side walls folded upwardly from opposite sides of the base wall, a first top wall folded inwardly from the top of one of the side walls, a second top wall folded inwardly from the top of the other of the side walls over the top of the first top wall, whereby said base wall, side walls and top walls define a socket with an opening at a front end thereof for receiving the terminal pin member, a terminating section extending from the base wall at a rear end of the socket, a first spring arm folded downwardly from a rear end of the first top wall into the socket, the first spring arm being tapered from a wide end thereof substantially the same width as the top wall and joined to the first top wall to a narrow free end thereof which does not interfere with the terminating section during stamping and forming of the electrical terminal socket, and a second spring arm folded downwardly from a front end of the first top wall into the socket.

9. The electrical terminal socket of claim 8 wherein said second spring arm includes a free end engageable with the terminal pin member inserted into said socket.

10. The electrical terminal socket of claim 9 wherein the narrow free end of said first spring arm is located behind the free end of the second spring arm to provide spring backup therefor.

11. The electrical terminal socket of claim 8 wherein said terminating section comprises a crimping section for clamping onto an appropriate electrical conductor.

12. The electrical terminal socket of claim 11 wherein said crimping section includes at least one crimp arm extending laterally outwardly relative to the socket at a side thereof coincident with said one side wall from which the first top wall is folded.

13. A method of fabricating an electrical terminal socket for receiving a terminal pin member, comprising the steps of:

stamping a blank from a single sheet of conductive metal material such that the blank includes a central base wall section, a pair of side wall sections at opposite edges of the base wall section, a top wall section at an edge of one of the side wall sections, a terminating section extending rearwardly from the base wall section, and a spring arm section extending rearwardly from the top wall section, the spring arm section being tapered from a wide end thereof substantially the same width as the top wall section and joined to the top wall section to a narrow free end thereof which accommodates the terminating section; and folding the stamped blank into the shape of a socket having an opening at a front end thereof for receiving the terminal pin member and including folding said side wall sections upwardly from opposite sides of the base wall section to form side walls of the socket, folding the top wall section inwardly from the top of one of the side walls to form a top wall of the socket, and folding the spring arm section downwardly from a rear end of the top wall to form a spring arm extending into the socket.

14. The method of claim 13 wherein said spring arm comprises a first spring arm, and including the steps of stamping a second spring arm section extending forwardly from the top wall section and folding the second spring arm section downwardly from a front end of the top wall to form a second spring arm extending into the socket.

15. The method of claim 14 wherein said second spring arm is stamped with a free end engageable with the terminal pin member inserted into said socket.

16. The method of claim 15 wherein said narrow free end of the first spring arm is folded behind the free end of the second spring arm to provide spring backup therefor.

17. The method of claim 16, including stamping said terminating section into a crimping section for clamping onto an appropriate electrical conductor.

18. The method of claim 17, including stamping said crimping section with at least one crimp arm extending laterally outwardly relative to the base wall section coincident with said one side wall section from which the top wall section extends.

* * * * *